United States Patent [19]

Taylor

[11] Patent Number: 4,999,964

[45] Date of Patent: Mar. 19, 1991

[54] FLOOR GRID SYSTEM

[75] Inventor: John R. Taylor, Irving, Tex.

[73] Assignee: Innovative Building Products, Inc., Grand Prairie, Tex.

[21] Appl. No.: 347,446

[22] Filed: May 4, 1989

[51] Int. Cl.[5] ..... E04B 5/52

[52] U.S. Cl. ..... 52/477; 52/741

[58] Field of Search ..... 52/457–477, 52/656, 396, 664, 308, 741

[56] References Cited

U.S. PATENT DOCUMENTS

| | | | |
|---|---|---|---|
| 1,289,188 | 12/1918 | Keppler | 52/553 |
| 1,667,484 | 4/1928 | Liese | 52/308 |
| 1,798,088 | 3/1931 | Janzen | 52/308 |
| 1,893,101 | 1/1933 | Old | 52/396 |
| 1,913,957 | 6/1933 | Richards | 52/477 |
| 1,940,968 | 12/1933 | Ohlis | 52/217 |
| 1,946,977 | 2/1934 | Lenke | 404/24 |
| 1,971,160 | 8/1934 | Lenke | 52/477 |
| 1,987,490 | 1/1935 | Mulford | 52/460 |
| 2,030,718 | 2/1936 | Richards | 52/416 |
| 2,031,986 | 2/1936 | Lenke | 52/656 |
| 2,052,229 | 8/1936 | Hyde | 52/308 |
| 2,110,628 | 3/1938 | Leiser | 52/307 |
| 2,124,799 | 7/1938 | Specht | 52/308 |
| 2,156,678 | 5/1939 | Cox | 52/308 |
| 2,174,844 | 10/1939 | Sedore | 52/307 |
| 2,182,971 | 12/1939 | Richards | 52/416 |
| 2,239,537 | 4/1941 | Owen | 52/308 |
| 2,346,170 | 4/1944 | Kalkusch | 52/308 |
| 2,367,610 | 1/1945 | Randall | 52/656 |
| 2,419,267 | 4/1947 | Lenke | 52/308 |
| 2,655,881 | 10/1953 | Lenke | 52/308 |
| 2,787,156 | 4/1957 | Goodwin | 52/308 |
| 2,835,623 | 5/1958 | Vincent et al. | 52/308 |
| 2,941,393 | 6/1960 | McDavitt et al. | 52/308 |
| 3,012,378 | 12/1961 | Boyd | 52/308 |
| 3,234,699 | 2/1966 | Smith | 52/308 |
| 4,058,943 | 11/1977 | Sturgill | 52/307 |
| 4,628,645 | 12/1986 | Tafelski | 52/477 |
| 4,648,226 | 3/1987 | Manon | 52/308 |

*Primary Examiner*—James L. Ridgill, Jr.
*Attorney, Agent, or Firm*—Kenneth R. Glaser

[57] ABSTRACT

A floor assembly for a building structure includes a plurality of support members defining a horizontal perimeter supported by the building structure. A grid formed of a plurality of horizontal grid members extends between the support members. Pocket surfaces on adjoining ones of the grid members define pockets for glass blocks. The glass blocks define horizontal glass floor surface supported by the grid members, with the grid members being supported by the support members.

7 Claims, 3 Drawing Sheets

FLOOR GRID SYSTEM

TECHNICAL FIELD

This invention relates to building structures, more particularly to load bearing glass block assemblies, and even more particularly to an assembly for forming a floor or other flat structure of glass blocks.

BACKGROUND OF THE INVENTION

Glass blocks have long been used in building structures, particularly in vertical walls where the transparency of the glass blocks creates a highly distinctive and desirable visual effect. The use of glass blocks in floor structures, however has been limited due to the difficulty in providing adequate load carrying capability for such structures. Therefore, there presently exists a need for a system whereby glass blocks can be efficiently utilized in a load bearing floor structure.

SUMMARY OF THE INVENTION

The present invention provides a load bearing, specifically floor, assembly for a building structure wherein glass blocks can be effectively utilized. The floor assembly includes a plurality of support members, including a one-piece containment ring, defining a horizontal perimeter supported by the building structure in which the assembly is installed. A grid is formed of a plurality of horizontal grid members which extend between the support members. The grid members include lateral members spanning between ones of the support members and transmitting the load of the floor to the support members. The grid members also include a plurality of non-load bearing segment members spanning between ones of the lateral members. Adjoining ones of the grid members have pocket surfaces which define pockets, and glass blocks are fitted into the pockets to form the floor assembly. A resilient boot cushions and holds each glass block in its respective pocket.

The invention described herein constitutes an improvement of the invention described in my co-pending patent application Serial No. 7/236,169, filed August 25, 1988, such description being incorporated by reference herein.

BRIEF DESCRIPTION OF THE DRAWINGS

A more complete understanding of the invention and its advantages will be apparent from the Detailed Description of the Preferred Embodiment taken in conjunction with the accompanying Drawings in which.

DETAILED DESCRIPTION OF THE PREFERRED EMBODIMENT

Figure 1:
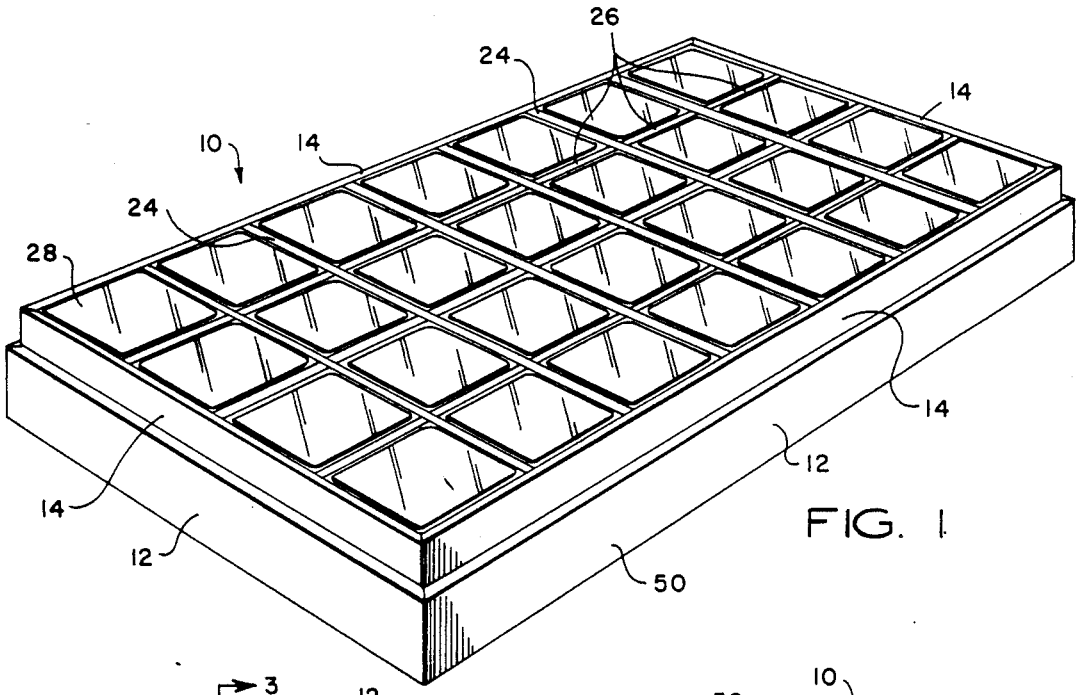
FIG. 1 is a perspective view of the floor assembly of the present invention.
Figure 2:
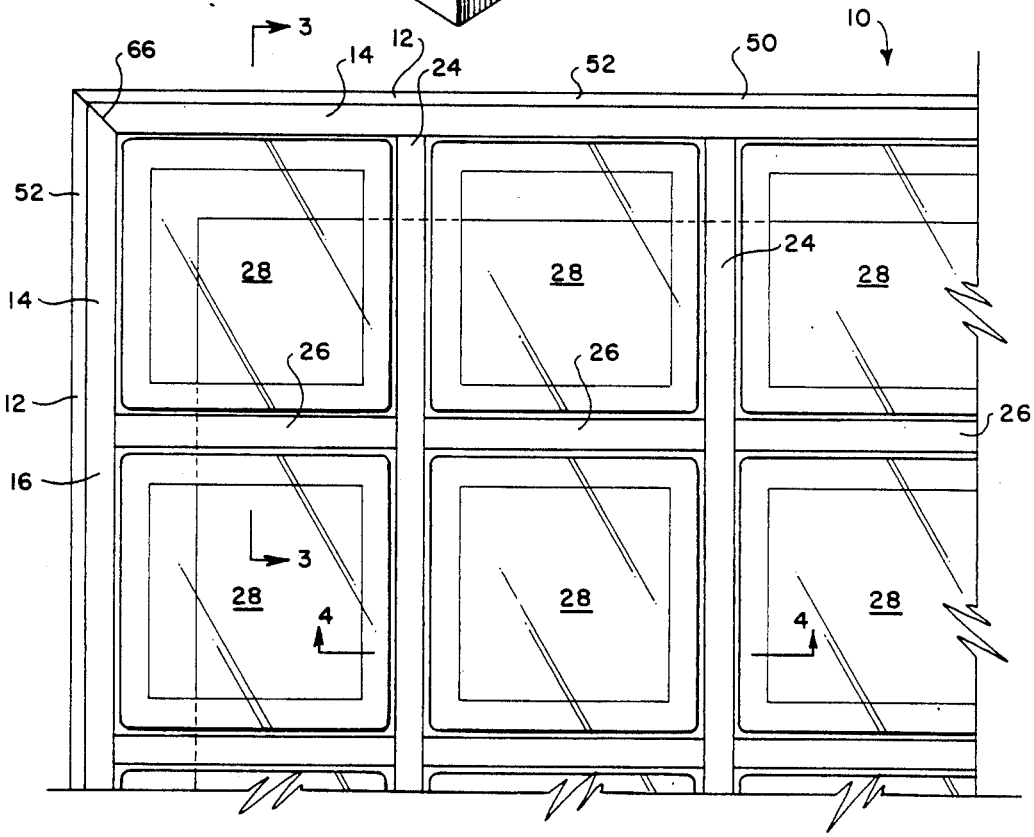
FIG. 2 is a partial overhead view of a corner of the assembly of FIG. 1.

Referring initially to FIGS. 1 and 2, floor assembly 10 is a unitary structure which can be utilized in substantially any building structure. Floor assembly 10 is intended to be supported by the surrounding building structure about the perimeter thereof, with the space below floor assembly 10 being substantially open for aesthetic lighting effects. While the floor assembly 10 illustrated is formed of a structure being four glass blocks in width and seven glass blocks in length, it will be understood that such configuration is for purposes of illustration only, and assemblies utilizing the invention can be constructed of virtually any length, width or pattern. In addition, while the invention is particularly well adapted for floors, it will be understood that other essentially flat structures such as skylights, walls and false ceilings can benefit from the features of this invention.

Floor assembly 10 includes a plurality of support members including containment members 12 and perimeter members 14 which define a horizontal perimeter to be supported by the surrounding building structure. A grid is formed of a plurality of horizontal grid members extending between the perimeter members 14 and including lateral members 24 and longitudinally-aligned segment members 26. As will be described in detail below, glass blocks 28 are supported by pocket surfaces defined by the grid members. Load is transferred from the glass blocks 28 to the lateral and segment members 24 and 26, respectively, which transfer the load to the perimeter members 14 and containment members 12, which in turn are supported by the surrounding building structure, such that glass block floor assembly 10 is supported substantially entirely about the perimeter thereof.

Figure 3:
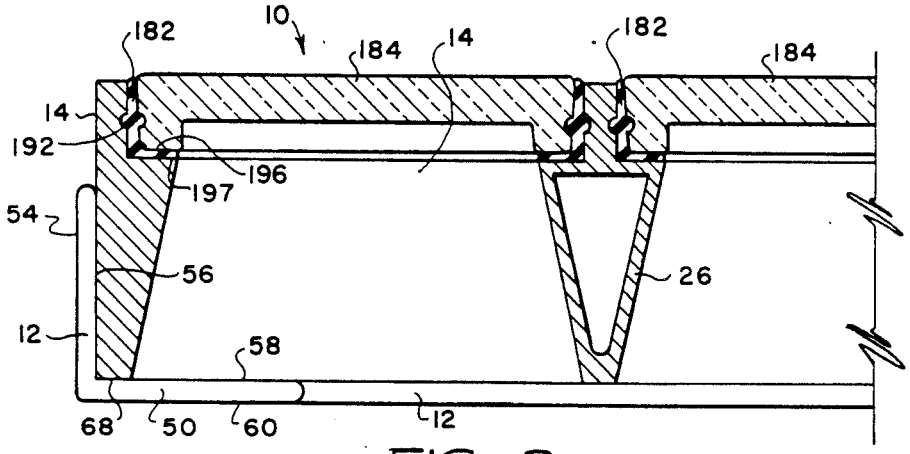
FIG. 3 is a sectional view taken along lines 3—3 of FIG. 2.
Figure 4:
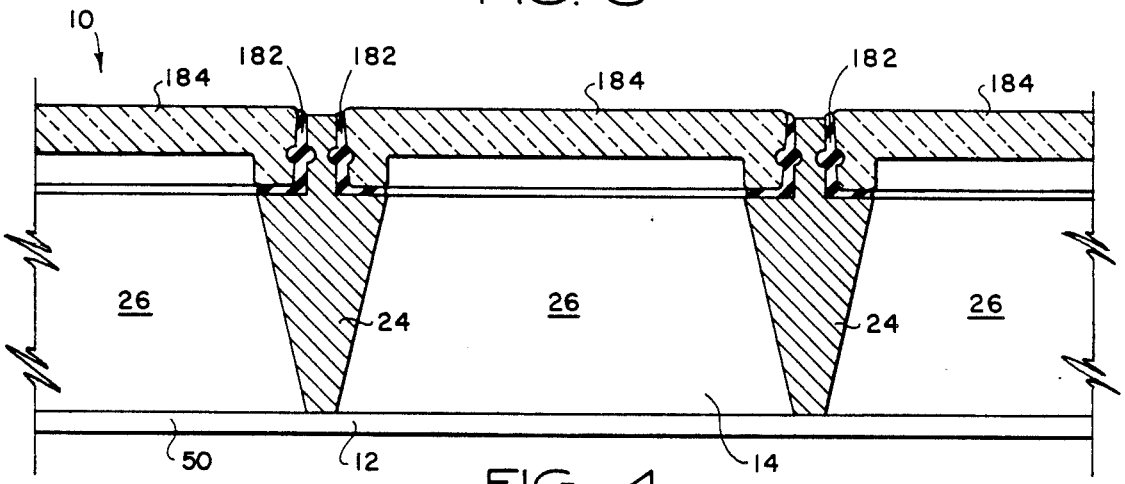
FIG. 4 is a sectional view taken along lines 4—4 of FIG. 2.
Figure 5:
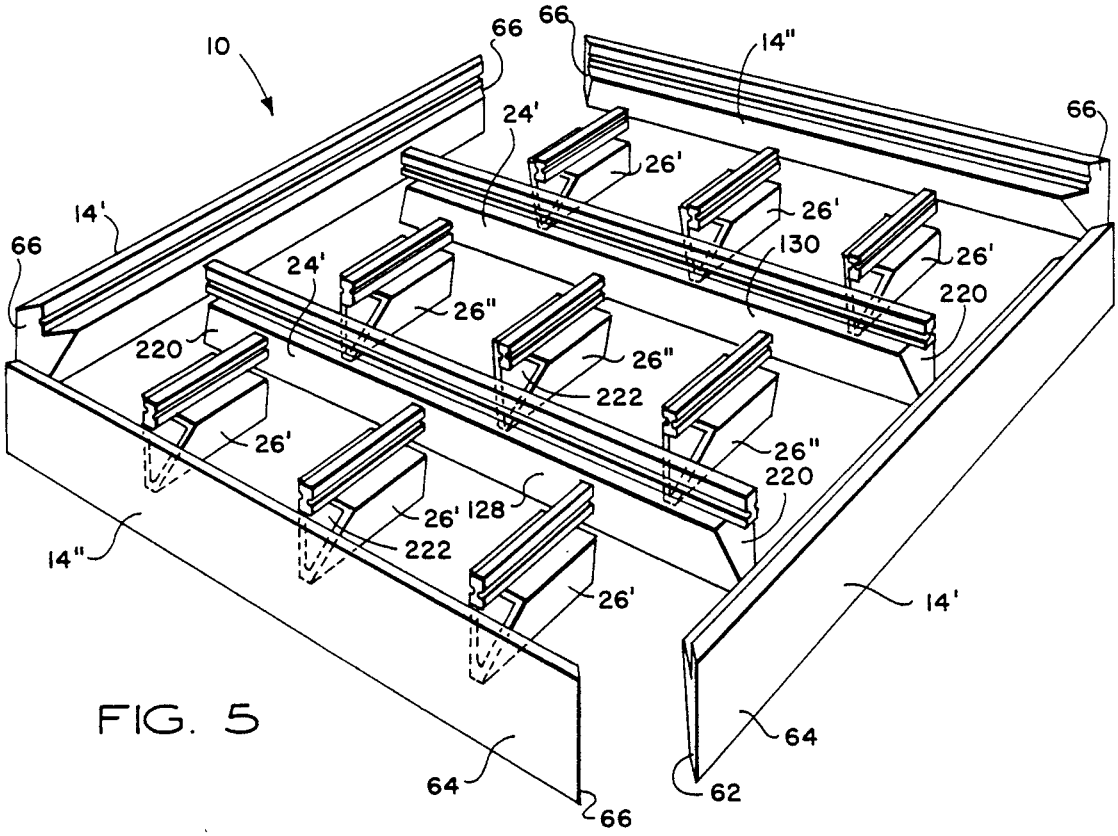
FIG. 5 is an exploded view of the perimeter and grid members of the assembly.

Referring now to FIGS. 3, 4 and 5 in addition to FIGS. 1 and 2, floor assembly 10 is preferably supported by a containing ring 50 formed from four co-planar containment members 12 joined, preferably welded, at the ends thereof to form a unitary perimeter body. Preferably, the containment ring 50 has opposite sides parallel and equal in length dimensions, such that glass blocks of a rectangular or preferably square configuration can be utilized. As best shown in FIG. 3, each of the containment members 12 has an "L"-shaped lateral cross-section, with upwardly-extending, vertical, inner and outer side walls 54 and 56, respectively and inwardly-extending, horizontal, upper and lower bottom walls 58 and 60, respectively. Preferably, containment members 12 are formed from standard steel angle stock, such that the thickness and width dimensions of the side and bottom walls of the containment members are substantially equal.

Four co-planar perimeter members 14 are interfitted at the ends thereof, with outer surfaces 64 (FIGS. 3 and 5) being substantially equal in length dimensions to the inner side walls 56 of the containment members 12. Outer surfaces 64 abut inner side walls 56 substantially entirely along the lengths thereof. Perimeter members 14 have mitered ends 66 (FIGS. 2 and 5), such that perimeter members 14 are substantially immobilized once they are inserted in an interfitted relationship into containment ring 50. Perimeter members 14 are supported vertically on bottom surfaces 68. Bottom surfaces 68 are substantially smaller in width dimension than upper bottom walls 58 of containment members 12, and bottom surfaces 68 abut outer portions of the upper bottom walls 58 substantially entirely along the lengths thereof.

The grid members extending between the support members include a plurality of unitary lateral members 24 which extend between a first opposing pair of perimeter members 14. Preferably, lateral members 24 extend laterally across the narrowest horizontal dimension of the floor assembly, because the entire load placed on the floor assembly is transmitted by way of the lateral members 24 to the perimeter members 14 and containment ring 50. It will be appreciated that the necessary load capacity and rigidity will be obtained more economically and efficiently by minimizing the lateral span of the lateral members 24. Thus, as shown in FIG. 1, lateral members 24 extend across the narrower dimension illustrated. The grid members further include a plurality of segment members 26 extending between each of a second opposing pair of perimeter members 14 and the lateral members 24 adjacent each of the second opposing pair of perimeter members. Segment members 26 also extend between adjacent ones of the lateral members 24.

Figure 8:
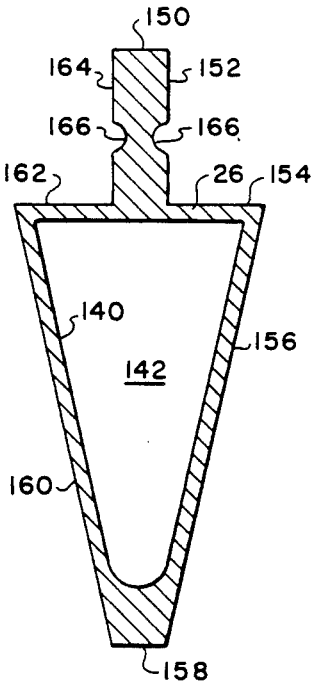
FIG. 8 is a partially broken away side view of a segment member of the floor assembly.

As best shown in FIG. 5, the perimeter members 14' and 14'' form the rectangular perimeter of the floor assembly 10 when interfitted at their mitered ends 66. Lateral members 24' extend between the first opposing pair of perimeter members 14'. The segment members 26' extend between the second opposing pair of perimeter members 14'' and the adjacent lateral members 24'. Segment members 26'' extend between lateral members 24' which are adjacent to each other as well as being adjacent to ones of the second opposing pair of perimeter members 14''. As stated above, the relative numbers of the grid members are substantially unlimited, and the numbers of grid members shown in FIG. 8 are for illustrational purposes only. The lateral members 24' are perpendicular to the first opposing pair of perimeter members 14'. Lateral members 24' are equally spaced between adjacent ones thereof. The segment members 26' and 26'' are longitudinally aligned, as best shown in FIGS. 2 and 5, and are perpendicular to the second opposing pair of perimeter members 14''. The segment members 26' and 26''are equally spaced between adjacent lateral ones thereof.

Figure 6:
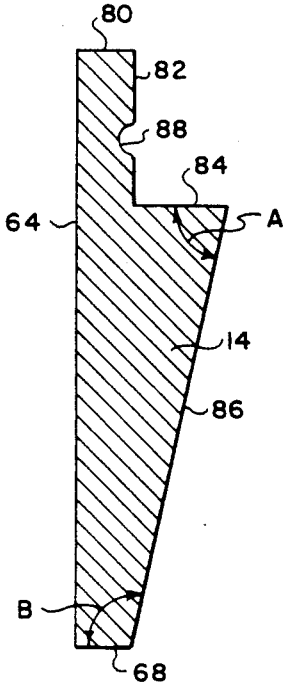
FIG. 6 is a partially broken away side view of a perimeter member of the floor assembly.

As best shown in FIG. 6, the perimeter members 14 are solid members preferably formed of extruded aluminum alloy. Each perimeter member has outer surfaces defining a lateral "half-arrowhead" cross-section. The "half-arrowhead" cross-section is defined by the vertically-planar outer surface 64 previously described which is joined to a horizontally-planar top surface 80. The top surface 80 is joined to a vertically-planar upper inner surface 82, which in turn is joined to a horizontally-planar middle inner surface 84. Upper inner surface 82 and middle inner surface 84 are pocket surfaces, which define pockets for the glass blocks as will be described in detail below. An angled-planar lower inner surface 86 extends from middle inner surface 84 at an acute included angle A and is joined to horizontally-planar bottom surface 68 at an obtuse included angle B. A semi-cylindrical wall 88 defines a horizontal pocket groove centrally located in upper inner surface 82.

Figure 7:
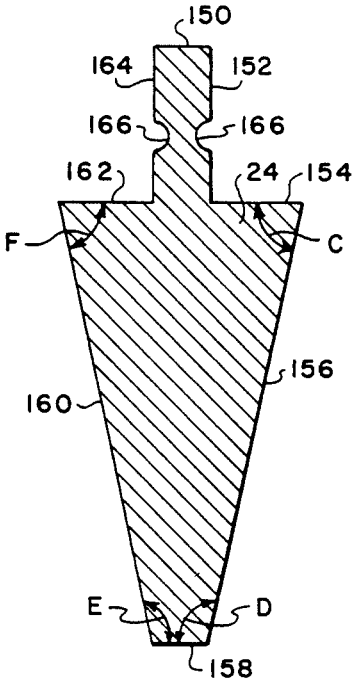
FIG. 7 is a partially broken away side view of a lateral member of the floor assembly.

Referring now to FIGS. 7 and 8, the lateral and segment members 24 and 26, respectively, are preferably identical in cross-section except the lateral members 24 are formed of a solid aluminum alloy extrusion whereas the segment members 26 have interior surfaces 140 defining a hollow interior 142. The lateral members 24 are preferably solid throughout because they carry the load of the floor to the perimeter members 14. The segment members 26, on the other hand, carry little if any load and therefore are preferably formed of an aluminum alloy extrusion having a hollow interior 142 as shown, to minimize the weight and cost of the segment members.

As best shown in FIGS. 7 and 8, each of the lateral and segment members 24 and 26, respectively, includes outer surfaces defining a lateral "full-arrowhead" cross-section, in contrast to the "half-arrowhead" cross-section of the perimeter members 14 shown in FIG. 6. The "full-arrowhead" cross-section is defined by a horizontally-planar top surface 150 joined to a vertically-planar first upper surface 152. First upper surface 152 is joined to a horizontally-planar first middle surface 154. First middle surface 154 is in turn joined to an angled-planar first lower surface 156. Preferably, first lower surface 156 forms an acute included angle C with first middle surface 154 A horizontally-planar bottom surface 158 is joined to first middle surface 156 at an acute angle A. An angled-planar second lower surface 160 is joined to and forms an obtuse included angles with bottom surface 158 the complement of the included angle C between first middle surface 154 and first lower surface 156. Second middle surface surface 160 is joined to horizontally-planar second middle surface 162 at an acute included angle F complementary to angle D, which in turn is joined to vertically-planar second upper surface 164. Semi-cylindrical walls 166 define horizontal pocket grooves centrally located in the upper surfaces 152 and 164. In preferred form, angles A, C and F are substantially equal, and angles B, D and E are substantially equal.

While the described embodiment utilizes perimeter members and lateral members of solid aluminum, and segment members of hollow aluminum, it will be understood that light load requirements may enable the use of hollow cross-sections throughout the assembly while heavy load requirements may require the incorporation of steel reinforcement members within some or all of the members. It will also be understood that while extruded aluminum is preferred as a material for the members, numerous other materials could be utilized depending on strength requirements and the desired visual effect. Finally, it will be understood that the configurations and width and depth dimensions of the members are variable from those illustrated and described herein depending, again, on strength requirements and the desired visual effect.

Figure 9:
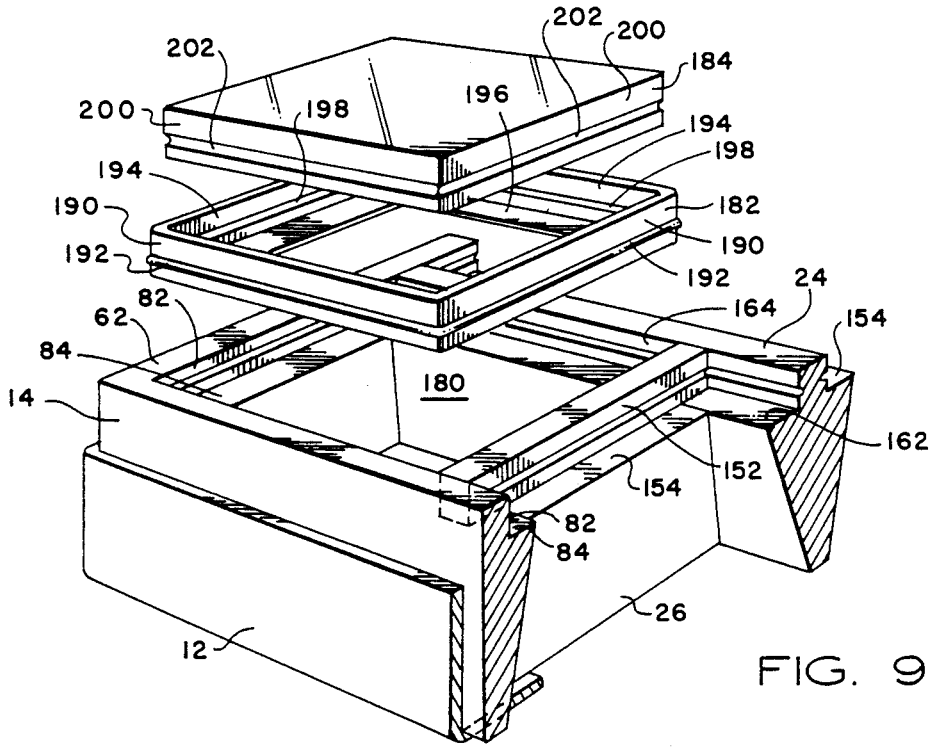
FIG. 9 is an exploded view of the floor assembly.

As best shown in FIG. 9, the lateral and segment grid members 24 and 26, respectively, either in combinations of opposing pairs thereof or in combinations with adjacent perimeter members 14, as the case may be, include pocket surfaces which define a rectangular pocket 180 for receiving resilient boots 182 and glass blocks 184. Specifically, pocket 180 in FIG. 9 is formed by the upper inner surfaces 82 of the perimeter members 14, the first and second upper surfaces 152 and 164, respectively, of the lateral members 24 and the segment members 26. Pockets located away from the perimeter members 14 will be formed by adjoining first and second upper surfaces 152 and 164, respectively, and first and second middle surfaces 154 and 162, respectively, of opposing pairs of lateral members 24 and segment members 26. Preferably, the pockets 180 are square in horizontal cross-section, but it will be recognized that pockets and glass blocks of almost any size and shape can be utilized with the present invention.

Referring now to FIGS. 3, 4 and 9, the boots 182 are formed of a resilient material such as neoprene and are fitted into each square pocket. Each boot has four vertical outer walls 190 abutting the vertically-planar pocket surfaces. Each boot 182 also has four inner surfaces 194 which are slightly angled from vertical, as best shown in FIGS. 3 and 4. Each boot 182 also has horizontally-planar inner surfaces 196 and outer surfaces 197 (FIG. 3), such that the boots 182 have lateral "L"shaped cross-sections. Each of the slightly-angled-from-vertical inner surfaces 194 includes an inwardly extending rib 198.

As best shown in FIG. 9, a glass block 184 is fitted to each boot 182. Each glass block 184 preferably has square horizontal cross-sections with four substantially rectangular side walls 200 being slightly angled from vertical. The side walls 200 each have a semi-cylindrical wall 202 defining a groove located to interfit with the ribs 198 on the boot inner surfaces. In similar fashion, ribs 192 on the boot outer surfaces interfit with the pocket grooves in the pocket surfaces, as best shown in FIGS. 3 and 4.

The floor assembly according to the invention is easily constructed on-site without the need for pre-assembly or the use of cranes. Initially, the surrounding building structure is modified or constructed to support the containment ring 50 of the horizontal co-planar, welded containment members 12. Next, the four perimeter members 14 are inserted into the containment ring in an interfitted relationship. The lateral members 24, which have ends 200 (FIG. 5) cut to interfit with the inner perimeter member surfaces, are then intermeshed by rotation relative the perimeter members while being located at the correct elevation with respect thereto. Next, the grid is completed by installing each of the segment members 26, which have ends 222 (FIG. 5) cut to intermesh with the inner surfaces of the perimeter members 14 and the outer surfaces of the lateral members 24. Again, as in the case with the lateral members 24, the segment members 26 are easily installed by rotating them to be perpendicular to the adjacent perimeter members 14 and lateral members 24 while being located at the proper elevation with respect thereto. The completed grid defines the pockets 180 for the glass blocks 184, and the next step in the installation procedure is to fit a resilient boot 182 into each pocket 180. The floor assembly is then completed by installing a glass block 184 into each pocket containing a boot 182.

It can thus be seen that the present invention provides a new floor assembly and method of installing a floor wherein glass block is used as the primary load bearing surface. The glass block floor assembly is designed to be used in foot traffic areas, such as hallways or malls, to great aesthetic effect. The angled-planar lower surfaces of the perimeter and grid members increase the areas of the openings below the pockets, which enhances the transmission of light through the floor assembly.

The floor assembly can be constructed to any of an infinite number of dimensions, but preferably uses glass "paver" blocks being approximately one inch thick and six inches square. The resilient boots between the grid and the blocks serve as seals between the upper and lower sides of the floor assembly and also as buffers between the glass blocks and the metal perimeter and grid members. If necessary or desired, gasket or lubricating compounds such as grease can be used in the boot area to improve the sealing and installation characteristics of the assembly. The floor assembly is assemblable on-site without the use of special tools or fasteners. The pre-assembled containment ring formed of angle bars and the half-arrowhead and full-arrowhead cross-sections of the perimeter and grid members allow for automatic interlocking when the perimeter and grid members are assembled. The segment members are slidable relative the lateral members until the boots and glass blocks are located in place, which completes the rigid assembly of the floor assembly unit.

Whereas the present invention has been described with respect to a specific embodiment thereof, it will be understood that various changes and modifications will be suggested to one skilled in the art and it is intended to encompass such changes and modifications as fall within the scope of the appended claims.

I claim:

1. A floor assembly for a building structure, comprising:

a plurality of support members defining a horizontal perimeter supported by the building structure, said support members including a containment ring formed from a plurality of coplanar containment members joined at the ends thereof to form a unitary body;

said containment members being angle members each having "L"-shaped lateral cross-sections with upwardly-extending, vertical, inner and outer side walls and inwardly-extending, horizontal, upper and lower bottom walls;

said support members further including a plurality of coplanar perimeter members interfitted at the ends thereof, each including a vertically-planar outer surface abutting and contained by one of said inner side walls of said containment members;

a grid formed of a plurality of horizontal grid members extending between said perimeter members;

pocket surfaces on adjoining ones of said grid members defining pockets; and a glass block fitted into each pocket, to form a floor assembly wherein said glass blocks define a horizontal glass floor surface supported by said grid members, with said grid members being supported by said support members.

2. The floor assembly of claim 1 wherein said containment members are four members with opposite sides parallel and equal in length dimensions.

3. The floor assembly of claim 1 with said perimeter members each including an angled-planar lower inner surface joined to and forming an included angle with said middle inner surface of about 78 degrees.

4. The floor assembly of claim 1 with said perimeter members each including outer surfaces defining a lateral "half-arrowhead" cross-section, said cross-section being defined by a vertically-planar outer surface abutting said containment members, a horizontally-planar top surface joined to said outer surface, a vertically-planar upper inner surface joined to said top surface, a horizontally-planar middle inner surface joined to said upper inner surface, an angled-planar lower inner surface joined to and forming an acute included angle with said middle inner surface of about 78 degrees, and a horizontally-planar bottom surface joined to said middle inner and outer surfaces.

5. The floor assembly of claim 1 with said perimeter members being substantially equal in length dimensions to said angle members and abutting said angle members substantially along the entire lengths thereof.

6. The floor assembly of claim 5 with bottom surfaces of said perimeter members being substantially smaller in width dimension than said upper bottom walls of said angle members and abutting outer portions of said upper bottom walls substantially along the entire lengths thereof.

7. A method for constructing a floor assembly for a building structure, comprising the steps of:

first, installing a plurality of support members defining a horizontal perimeter supported by the building structure, said support members including a unitary containment ring with upwardly-extending inner side walls and inwardly-extending upper bottom walls, and said support members further including a plurality of discrete perimeter members interfitted with said containment ring, each perimeter member having surfaces abutting said side and bottom walls of said containment ring;

second, forming a grid between said support members by extending a plurality of horizontal lateral members between opposing ones of said perimeter members, and by extending a plurality of horizontal segment members between opposing ones of said perimeter members and lateral members and opposing ones of said lateral members, with pocket surfaces on adjoining ones of said perimeter members, lateral members and segment members defining pockets; and third, fitting a glass block into each pocket, to form a floor assembly wherein said glass blocks define a horizontal glass floor surface supported by said lateral and segment members and with said lateral and segment members being supported by said perimeter members.

* * * * *